United States Patent [19]

Nelson et al.

[11] Patent Number: 4,877,197

[45] Date of Patent: Oct. 31, 1989

[54] INSTRUMENT HOUSING WITH IMPROVED PAPER FEED

[75] Inventors: John R. Nelson, Oviedo; Thomas F. Lehman, Winterpark, both of Fla.

[73] Assignee: Invivo Research, Inc., Broken Arrow, Okla.

[21] Appl. No.: 223,447

[22] Filed: Jul. 22, 1988

[51] Int. Cl.[4] ..... B65H 19/00; B41J 15/00

[52] U.S. Cl. ..... 242/68.7; 242/55.2; 400/613; 312/39

[58] Field of Search ..... 242/55.2, 68.7, 55.3, 242/55.53; 312/39, 208; 400/613, 613.1, 614, 693

[56] References Cited

U.S. PATENT DOCUMENTS

| | | | |
|---|---|---|---|
| 3,603,519 | 9/1971 | Brown et al. | 312/39 X |
| 3,829,185 | 8/1974 | Lloyd | 312/39 |
| 4,079,826 | 3/1978 | Shaw | 400/613 |
| 4,302,102 | 11/1981 | Stark et al. | 242/55.2 X |
| 4,372,694 | 2/1983 | Bovio et al. | 400/613.1 X |
| 4,641,980 | 2/1987 | Matsumoto et al. | 400/613 X |

*Primary Examiner*—Stuart S. Levy
*Assistant Examiner*—Steven M. DuBois
*Attorney, Agent, or Firm*—Head & Johnson

[57] ABSTRACT

An instrument housing having an improved means for storing a roll of paper of selected width and maximum diameter for use by a printer in which the housing has a rectangular opening in the top adjacent the housing front and a rectangular opening in the front forward of and below the opening in the top. A paper trough is positioned within the instrument housing below the top opening and rearwardly of the front opening, the trough having an open top and having opposed parallel sides and a rearward wall and a bottom wall which merge into a quarter circular integral intersection, the radius of curvature of the intersection being about one-half of the maximum diameter of the paper roll for which the trough is dimensioned. A trough gate forms a front wall, the trough gate having a downwardly extending inner surface curved at the lower portion thereof toward the trough back wall at a radius of curvature substantially equal to that of the radius of curvature of the intersection of the trough rearward and bottom walls, and the trough gate having a bottom wall spaced slightly above the trough bottom wall providing a slot therebetween whereby when a roll of paper is positioned within the trough the free end of the paper may exit the trough through the slot. An electrically actuated printer mechanism is positioned in the housing forward of the trough gate, the printer having means to receive the paper for pulling paper through the slot as the printer functions.

1 Claim, 3 Drawing Sheets

INSTRUMENT HOUSING WITH IMPROVED PAPER FEED

SUMMARY OF THE INVENTION

This invention relates to an instrument housing having an improved paper feed. The instrument housing may typically be of a portable or a semi-portable type and generally formed of relatively a thin-wall, stiff material, such as plastic or metal. The instrument housing has a front, a bottom, a top surface, a rear surface and opposed sides. The front of the instrument housing has a generally rectangular opening therein. The top of the housing also has a generally rectangular opening. The front opening is forward of and below the top opening.

Positioned within the front opening is an electrically operated printer mechanism which has a slot therein from which paper having passed through the printer mechanism is discharged. The improvement of this invention is in the mechanism for holding the paper in conjunction with the printer and the instrument housing.

Printer paper is typically supplied on rolls of preselected width and of maximum diameter. Such rolls of paper are commercially available and typically may be such as 1½ to 2" in width and the rolls may be typically 1½ to 2½" in diameter. This disclosure provides an improved means of receiving a roll of paper for use by a printer in an instrument housing.

Positioned within the instrument housing below the top opening therein is a trough. The trough has an opened top, an opened front and has opposed parallel sides, a rearward wall and a bottom wall. The rearward and bottom walls merge into a quarter circular integral intersection, the radius of curvature of which should be about one-half of the maximum diameter of the roll of paper for which the trough is dimensioned to receive. The spacing between the side walls is slightly greater than the width of the paper the trough is dimensioned to receive.

A trough gate is secured to the trough and forms a front wall therefor. The trough gate is of width substantially equal to the width between the opposed trough side walls. The trough gate has a downwardly extending inner surface curved at the lower portion thereof towards the trough back wall at a radius of curvature substantially equal to the radius of curvature of the intersection of the trough rearward and bottom walls. The trough gate has a bottom wall spaced slightly above the trough bottom wall providing a slot therebetween.

The curved bottom and back wall surface of the trough and the curved portion of the gate together form a recess having a semi-circular bottom, the diameter of the semi-circle being equal to or slightly greater than the maximum diameter of a roll of paper for which the trough is dimensioned to receive. The trough and trough gate are, as above-indicated, positioned within the instrument housing rearwardly of the front opening and directly below the housing top opening.

An electrically actuated printer mechanism is positioned in the housing forward of the trough gate and the printer mechanism closes the front opening in the instrument housing. The printer has a passageway therethrough to receive paper from a roll positioned within the trough and trough gate. The free end of the roll of paper passes through the slot below the trough gate bottom wall and through the passageway in the printer and exits the instrument housing through a slot in the front wall of the printer.

An improved door is provided for the opening in the instrument housing top surface. Formed in the instrument housing below the top cover surface are two sets of opposed channels or slots. The upper slot is of a width less than the lower slot. The door has an integral upper surface which conforms to and substantially closes the opening in the instrument housing top with a lower integral ledge extending around the door. This lower ledge is receivable in the lowermost slot in the instrument housing.

A wide spring element is affixed to the door lower surface and has an overlapping tongue portion which is bent back in a U-shaped configuration and of increased width. This increased width tongue portion is received in the narrower, first mentioned slot.

To open the door to provide access to the interior of the instrument housing such as for the purpose of inserting a roll of paper into the trough portion, the user slightly depresses the door and moves it rearwardly, the door sliding in the widest slot. The tongue portion of the spring affixed to the door slides in the narrower slot so that the door, with its attached spring, can be slid rearwardly, fully exposing the opening in the instrument housing top to permit the roll of paper to be inserted into the instrument when necessary. To close the door the user slides the door forwardly. When the upper portion is in alignment with the opening in the instrument housing, the spring urges the door upwardly, closing the opening. The spring retains the door in such closed position as long as no force is exerted to depress it downwardly. Thus, a door is provided which is economically formed and which can be slid to expose an opening in the instrument housing requiring a minimum use of space within the interior of the housing.

The invention will be better understood with reference to the description of the preferred embodiments and the claims appended hereto, taken in conjunction with the attached drawings.

DESCRIPTION OF THE DRAWINGS

FIG. 4 is a top view of the door with its attached spring.

FIG. 5 is a partial view of the lower surface of the instrument housing top and showing a bottom view of the door and the leaf-spring and showing the door in the closed position.

FIG. 6 is a cross-sectional view taken along the line 6—6 of FIG. 5 and showing a portion of the top of the instrument housing and showing the door in the closed position.

FIG. 7 is a cross-sectional view of FIG. 6, but showing the door in the open position.

FIG. 8 is a cross-sectional view taken along the line 8—8 of FIG. 7 showing the slots formed in the instrument housing top in which the leaf-spring and the door slide when the door is in the open position.

DESCRIPTION OF THE PREFERRED EMBODIMENTS

Figure 1:
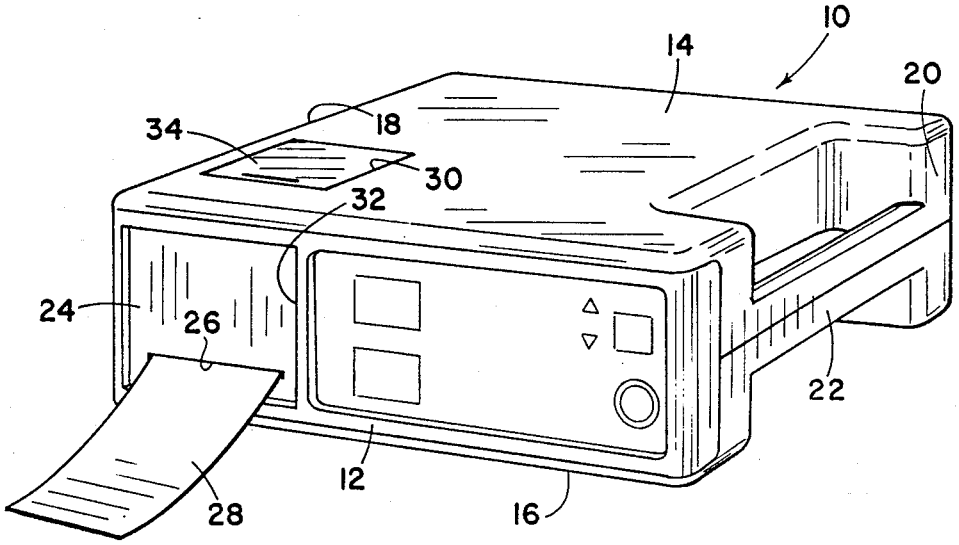
FIG. 1 is an isometric front view of an instrument housing which employs the principles of this invention.

FIG. 1 is an isometric view of an instrument housing which employs the principles of this invention. The instrument housing is indicated generally by the numeral 10 and has a front surface 12, a top surface 14, a bottom surface 16 and opposed end walls 18 and 20. End wall 29 includes an integral handle portion 22 which is typical of portable instruments to which this invention may be applied, however, such is not part of the invention. Instead, the present invention is concerned with the type of instrument which includes an electrically actuated printer 24 which has a slot 26 therein out of which the free end of a length of paper 28 passes as the printer is actuated. The invention is concerned with means for accommodating a roll of paper from which the free end of the paper 28 extends.

Formed in the instrument housing top surface 14 is an opening 30, the opening being immediately rearward of the printer 24 which fits in an opening 32 in the housing front surface 12. The top opening 30 is closed by door 34. When the door is moved to the opened position in a manner to be described subsequently, a recess is provided within the interior of the instrument housing 10 to receive a roll of paper, the free end of such roll of paper being indicated by the numeral 28.

Figure 2:
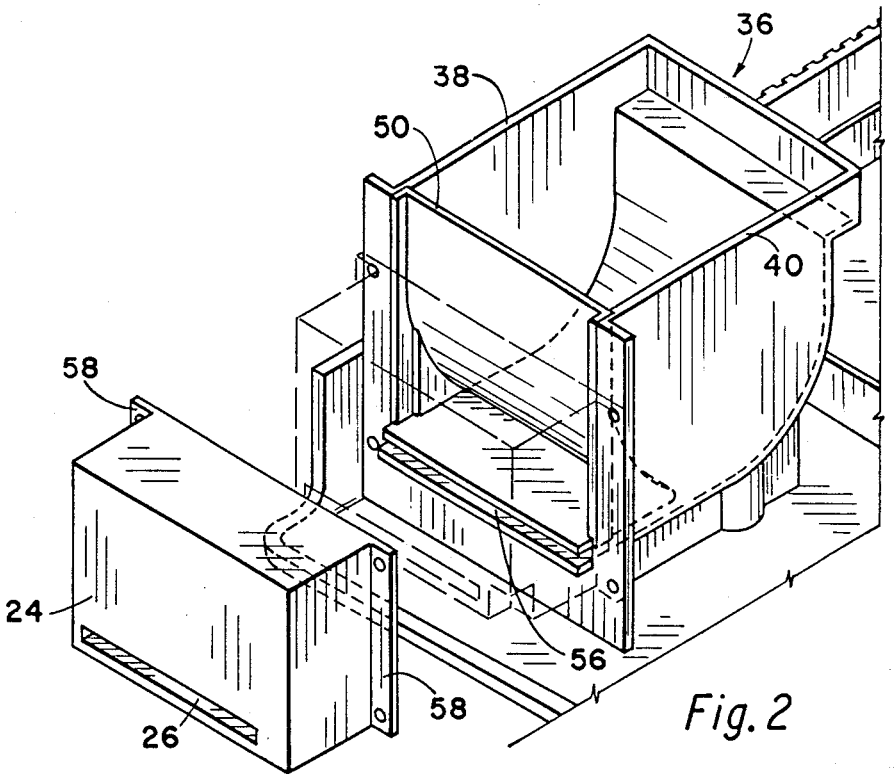
FIG. 2 is an isometric view of the trough and trough gate which provide means for receiving a roll of paper within the instrument housing and showing an electrically actuated printer mechanism which is received in the instrument housing and which closes the form opening therein. Paper from the trough portion passes through the printer in the process of recording information by means of the printer.
Figure 3:
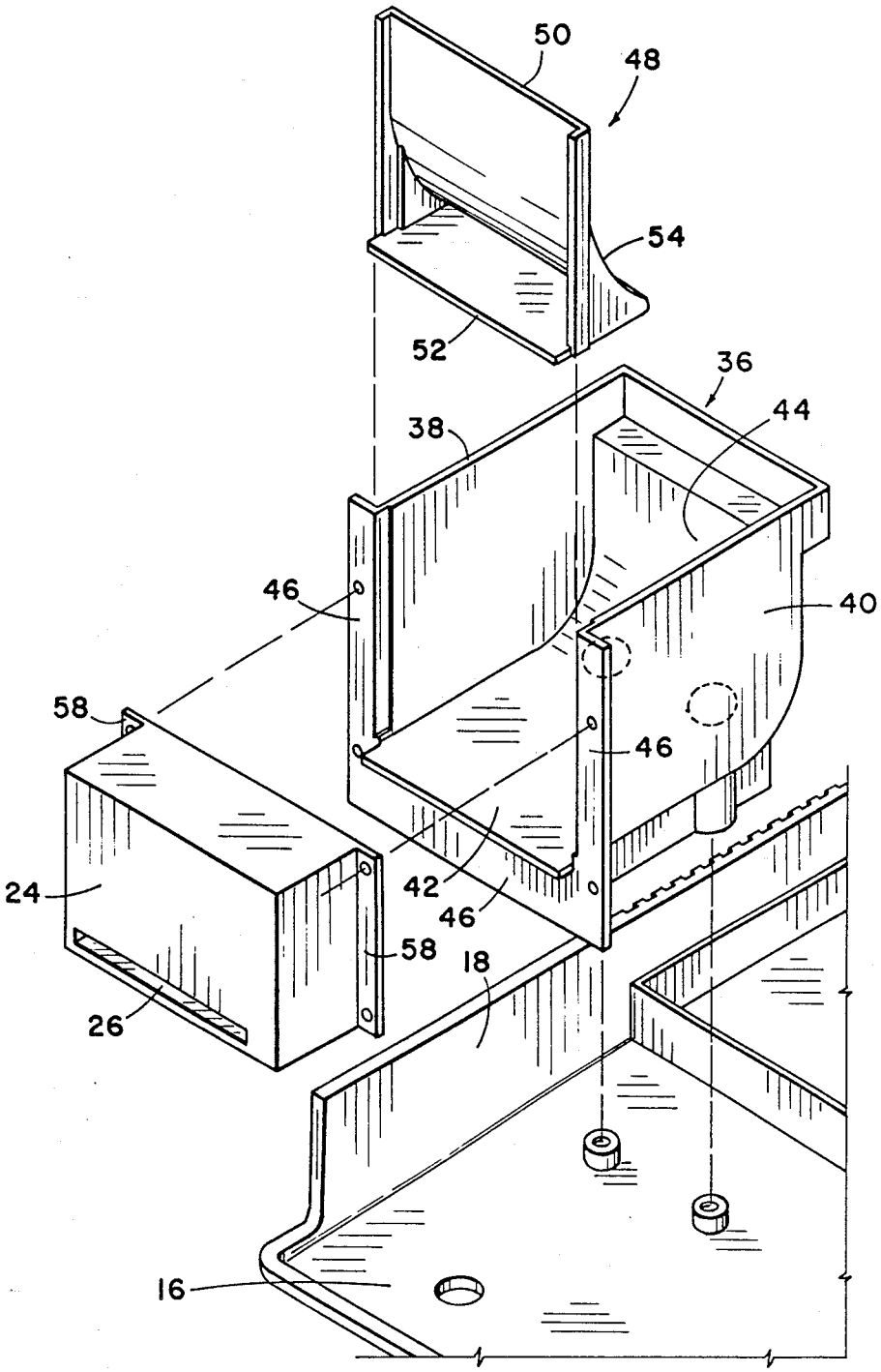
FIG. 3 is an exploded view showing an interior view of the lower portion of an instrument housing and showing the trough and trough gate and printer as employed in the invention.

Referring now to FIGS. 2 and 3, the mechanism for receiving the roll of paper is best illustrated. Received within the instrument housing is a trough member generally indicated by the numeral 36 and which may be formed of thin-walled, light weight material such as plastic. The trough member 36 has side walls 38 and 40 which are spaced apart and are paralleled to each other, the spacing between the side walls 38 and 40 being slightly greater than that of the roll of paper which the housing is dimensioned to accept and from which roll of paper the free end 28 emanates. Trough 36 has a bottom surface 42 and a rear surface 44. The bottom and rear surfaces integrally meet in a onequarter radius, the amount of the radius being substantially that of the largest diameter roll of paper the trough is adaptable to accept.

The forward portion of the trough has integral flange portions 46.

A second element of the apparatus to receive the roll of paper is a trough gate generally indicated by the numeral 48 and which has a forward wall 50 and a bottom wall 52, the forward and bottom walls integrally merging to form a curved surface 54 of the radius of curvature substantially the same as the that of the radius of curvature of the intersection of the trough bottom wall 42 and rearward wall 44. As shown in FIG. 2, the trough gate 48, when received within the trough, forms, in combination with the trough, a lower semi-circular surface for receiving a roll of paper. A slot 56 is formed between the trough bottom wall 42 and the trough gate bottom wall 52 through which the free end 28 of the roll of paper passes.

The printer 24 has flanges 58 providing means for attachment of the printer to the trough since flanges 58 are dimensioned to be accepted by the trough flanges 46.

It can be seen that the trough, trough gate and printer together form three elements which provide an easy-to-use mechanism for receiving a roll of paper and for passage for the free end 24 out of the trough, below the trough gate and through the printer and, thus, out of the instrument housing.

Referring now to FIGS. 4 through 8 an improved arrangement for the door 34 which closes the opening 30 in the instrument housing top 14 is illustrated. The instrument housing top 14, as shown in the cross-sectional view 48, is integrally formed to provide two sets of opposed slots. The first set is formed by opposed slots 60A and 60B and a lower set of slots 62A and 62B. The lower slots 62A and 62B are spaced further apart than 60A and 60B. Both pair of slots are opposed and paralleled to each other.

Figure 4:
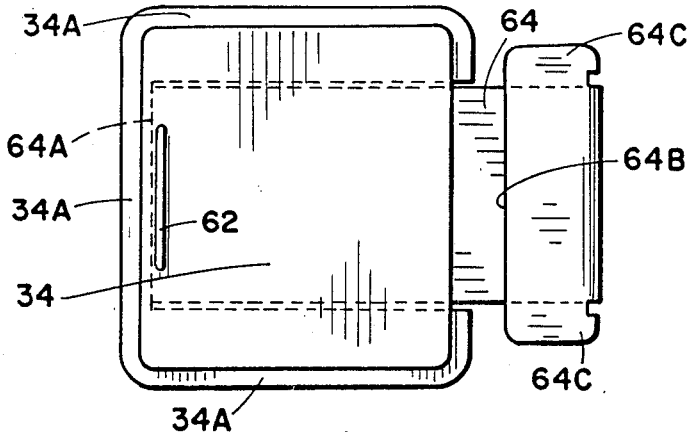
FIGS. 4 through 8 show an improved door for use with the instrument housing of FIG. 1.
Figure 5:
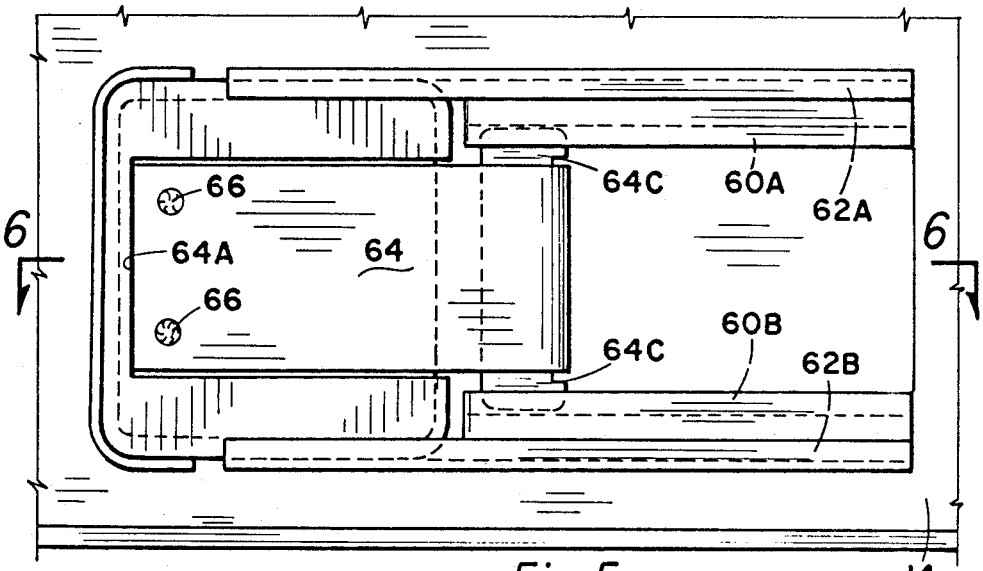

FIG. 4 is a top view of the door 34. The door has a lower integral flange portion 34A which extends completely around the front, opposed sides and a part of the back side of the back edge of the door. The door top surface has a recessed slot 62 therein dimensioned to receive the fingernail of the user to aid in sliding the door relative to the instrument housing top surface.

Affixed to the door 34 is a leaf-spring 64, preferably made of thin spring steel. The leaf-spring 64 is wide and generally flat. The forward portion 64A is attached to the door underneath side such as by the use of epoxy adhesive 66. Obviously the spring could also be attached to the door by the means of bolts or rivets.

Figure 8:
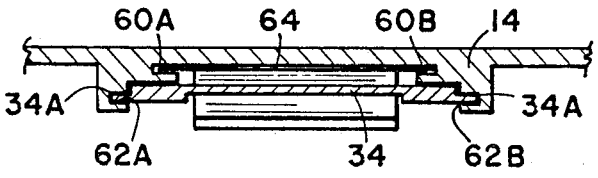

The rearward end 64B of the spring is folded back over itself in a U-shaped arrangement and the rearward end portion has increased width flanges 64C. These increased width flanges 64C are slideably received in the slots 60A and 60B formed in the instrument housing top 14, as seen in FIG. 8.

Figure 6:
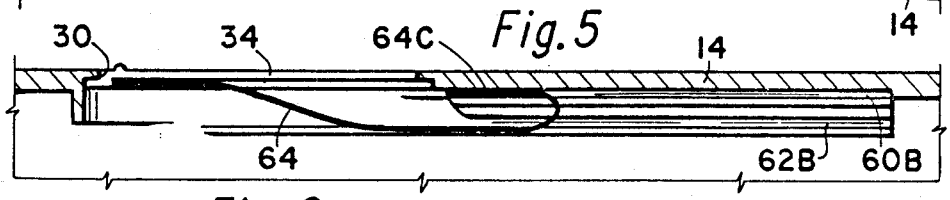
Figure 7:
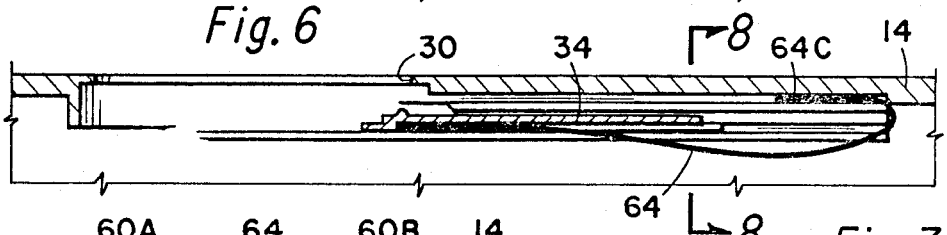

The leaf-spring 64 is bent as best seen in FIGS. 6 and 7 such that when the door 34 is in the closed position as shown in FIG. 6, the leaf-spring urges the door upwardly closing the opening 30 in the instrument housing top 14. To open the door the user depresses the door against the force of spring 34, pushing it downwardly so that the flange portions 34A of the door are in alignment with slots 62A and 62B in the instrument housing top 14. The door may then be slid rearwardly as shown in FIG. 7 with the flange portions 34A of the door being received in the slots 62A and 62B and with the leaf-spring increased width tongue portions 64C being slideably received in the slots 60A and 60B. In this manner the door is held in open position, fully exposing the opening 30 and permitting a roll of paper to be inserted into the interior of the instrument housing when necessary. The free end of the paper is inserted through the slot 56 below the trough gate and into contact with the printer so that upon actuation of the printer, the free end of the paper moves through the printer slot 26. After a roll of paper is installed, the user can close the door by sliding it forwardly until the door is immediately below th opening 30 at which time leaf-spring 34 will urge it upwardly into and enclosing the opening.

It can be seen that the unique door opening and closing systems requires only two components; that is, the door and the leaf-spring in conjunction with integral flanges molded into the housing top 14.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. An instrument housing having improved means for storing a roll of paper of selected width and maximum diameter for use by a printer comprising:

an instrument housing formed of thin-wall, stiff material such as plastic or metal and having a front and a top, the top having a generally rectangular opening therein adjacent the housing front and the front having a generally rectangular opening therein forward of and below said opening in said top;

a trough positioned within said instrument housing below said opening in said top and rearwardly of said opening in said front, the trough having an open top and front and having opposed paralleled side walls, and a rearward wall and bottom wall which merge into a quarter circular integral intersection, the radius of curvature of the intersection being about one-half of the maximum diameter of the paper roll for which the trough is dimensioned to receive and the spacing between said side walls being slightly greater than the width of paper roll the trough is dimensioned to receive;

a trough gate receivable by said trough and forming a front wall therefor, the trough gate being of a width substantially equal to the width between said trough sidewalls, the trough gate having a downwardly extending inner surface curved at the lower portion thereof towards said trough back wall at a radius of curvature substantially equal to said radius of curvature of said intersection of said trough rearward and bottom wall, and the trough gate having a bottom wall spaced slightly above said trough bottom wall providing a slot therebetween whereby when a roll of paper is positioned within said trough the free end of the paper may exit said trough through said slot; and an electrically actuated printer mechanism positioned in said housing forwardly of said trough gate and closing said housing front opening, the printer having means to receive paper from and for pulling paper through said slot as the printer functions.

* * * * *